United States Patent [19]

Iga

[11] Patent Number: 4,828,124

[45] Date of Patent: May 9, 1989

[54] EXTENSION JIB FOR A BOOM

[75] Inventor: Tadashi Iga, Kagawa, Japan

[73] Assignee: Tadano Ltd., Kagawa, Japan

[21] Appl. No.: 253,881

[22] Filed: Oct. 5, 1988

Related U.S. Application Data

[63] Continuation of Ser. No. 73,133, Jul. 14, 1987, abandoned.

[30] Foreign Application Priority Data

Jul. 21, 1986 [JP] Japan ..... 61-172399

[51] Int. Cl.[4] ..... B66C 23/70

[52] U.S. Cl. ..... 212/188; 212/187; 212/266

[58] Field of Search ..... 212/187, 188, 266

[56] References Cited

U.S. PATENT DOCUMENTS 3,831,771 8/1974 Wiencek ..... 212/188
4,044,952 8/1977 Williams et al. ..... 212/187

FOREIGN PATENT DOCUMENTS 59-74894 4/1984 Japan .
2041326 9/1980 United Kingdom ..... 212/188

*Primary Examiner*—Sherman D. Basinger
*Assistant Examiner*—Thomas J. Brahan
*Attorney, Agent, or Firm*—Armstrong, Nikaido, Marmelstein, Kubovcik & Murray

[57] ABSTRACT

A retractable extension jib for a telescopic boom has frame body rotatably mounted on an end of the boom so as to be rotated about a rotary axis, a horizontal shaft provided at a lower portion of the frame body and rotatably connecting a base portion of the extension jib. A pair of oil hydraulic cylinders are provided between a base portion of the extension jib and an upper portion of the frame body so as to rotate the jib about the horizontal shaft. The hydraulic cylinders are so arranged as to rotate the extension jib from a retracted position to a lower position where a longitudinal axis of the jib is substantially parallel with the rotary axis.

4 Claims, 7 Drawing Sheets

EXTENSION JIB FOR A BOOM

This application is a continuation of application Ser. No. 73,133, filed July 14, 1987, now abandoned.

BACKGROUND OF THE INVENTION

This invention relates to an extension jib attached to a boom, such as a telescopic boom.

An extension jib is attached to a tip of a telescopic boom of a crane such as a hydraulic truck crane, a rough terrain crane and others, in order to extend the available length of the boom. The extension jib is turned to a retracted waiting position on a side of the boom when it is not used.

In a prior art, the extension jib is moved between the extended position and the retracted position in a large space, as described later on.

SUMMARY OF THE INVENTION

The object of the present invention is to provide a telescopic jib having an extension jib which may be moved between the extended position and the retracted position within a small space.

According to the present invention, there is provided an extension jib for a telescopic boom, the extension jib having a frame body rotatably and detachably mounted on an end of the boom by connecting means so as to be rotated about a rotary axis which is in a lateral direction with respect to a longitudinal direction of the boom, a jib body rotatably connected to the frame body by a horizontal shaft, and locking means for locking the frame body to the end of boom so that the extension jib is positioned in an extended position.

The jib has a pair of hydraulic cylinders provided between a base portion of the extension jib and the frame body in such a manner that the jib is rotated about the horizontal shaft by the operation of the hydraulic cylinders.

The hydraulic cylinders are so arranged as to rotate the extension jib from a retracted position where a longitudinal axis of the jib is substantially parallel with a longitudinal axis of the boom to a lower position where the longitudinal axis of the jib is substantially parallel with the rotary axis.

The other objects and features of this invention will be apparently understood from the following description with reference to the accompanying drawings.

DETAILED DESCRIPTION OF THE PREFERRED EMBODIMENT

Figure 2:
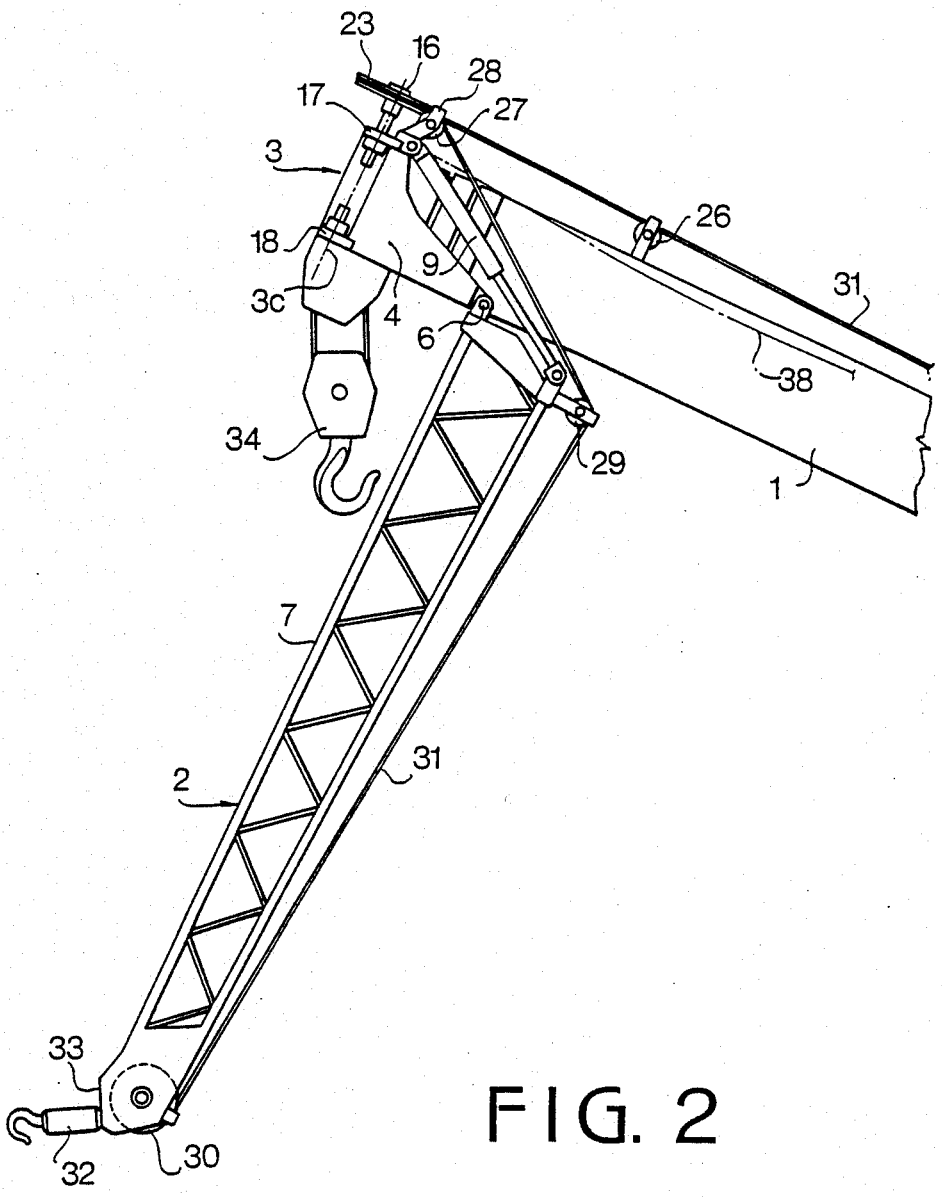
FIG. 2 is a side view of the telescopic boom showing an extending operation of the extension jib.
Figure 3:
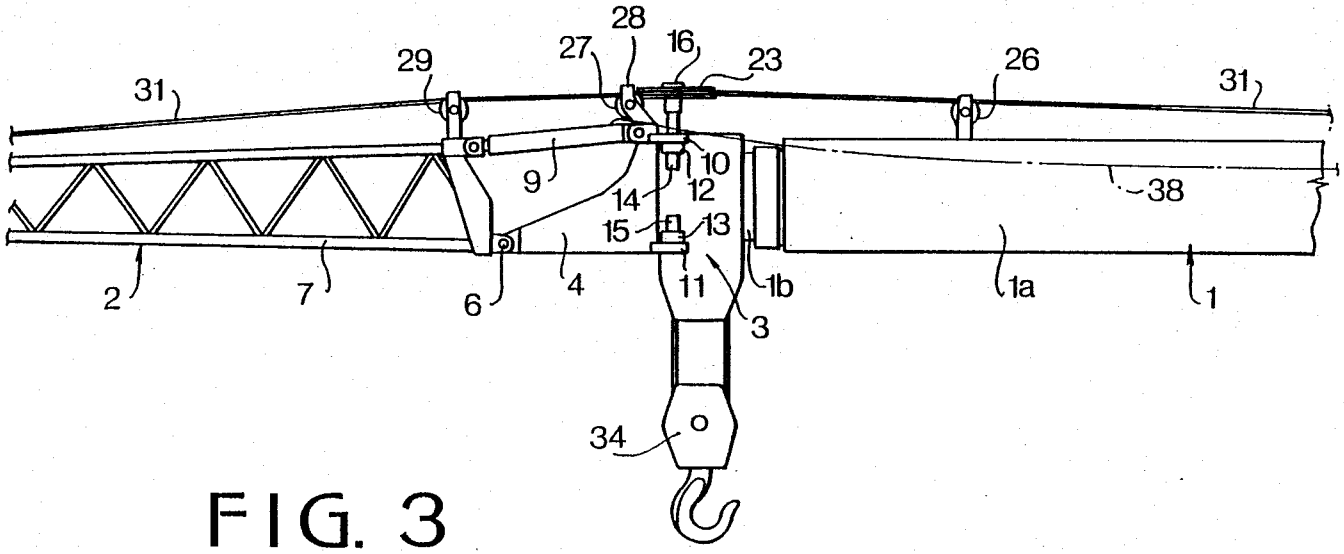
FIG. 3 is a side view of a part of the telescopic boom wherein the extension jib is in an extending position.
Figure 4:
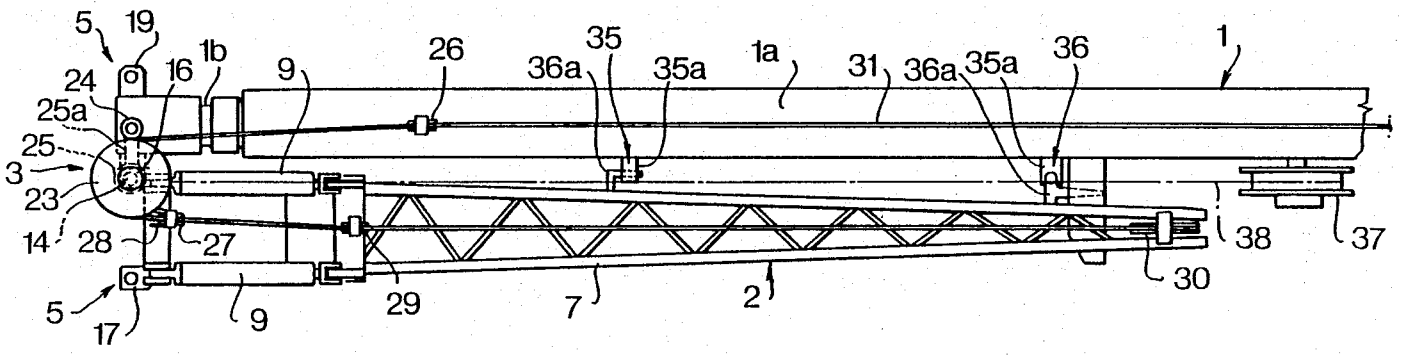
FIG. 4 is a plan view of the extension jib and the telescopic boom of FIG. 1.

Referring to FIGS. 1 to 5, a telescopic boom 1 for a jib crane is vertically rotatably mounted on a swivel stand (not shown) which is mounted on a travelling vehicle. An extension jib 2 attached to the boom 1 has a frame body 4 for connecting the jib 2 to the telescopic boom 1, a jib body 7, and hydraulic cylinders 9. The frame body 4 is detachably connected to the telescopic boom 1 through a coupling unit 3. The jib body 7 is pivotally connected to the frame body 4 by a horizontal shaft 6 at a lower end portion thereof. A pair of hydraulic cylinders 9 and 9 are parallelly provided between the jib body 7 and the frame body 4 as shown in FIG. 4. Each of hydraulic cylinders 9 is connected to the frame body 4 through a pivot **9*a* and connected to the jib body 7 through a pivot 9*b* opposite to the shaft 6, so as to connect the jib body 7 to the frame body 4. The hydraulic cylinder 9 is provided for controlling the position of the jib body 7 with respect to the frame body 4 and the boom 1** by means of hydraulic oil.

Figure 5:
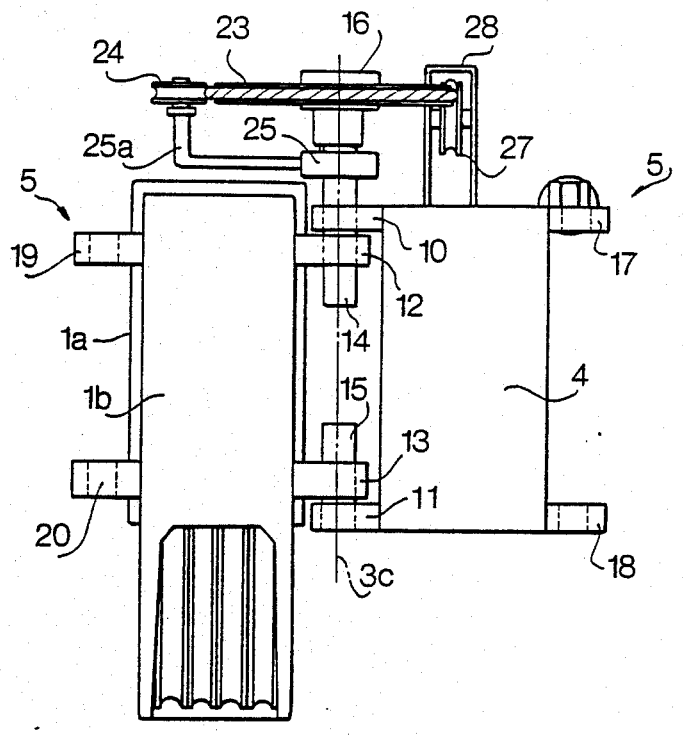
FIG. 5 is a front view of the extension jib and telescopic boom as viewed from the left side of FIG. 1.

Referring to FIG. 5, the coupling unit 3, which is provided for rotatably connecting the frame body 4 to the telescopic boom 1, comprises an upper bracket 10 and a lower bracket 11 formed on one side of the frame body 4 at a front end portion thereof, and an upper bracket 12 and a lower bracket 13 formed on one side of an innermost boom **1*b* of the telescopic boom 1 corresponding to the side of the frame body 4. Each of the brackets 10, 11, 12 and 13 has a hole coaxial with a rotary axis 3*c* which is in the lateral direction with respect to the longitudinal direction of the boom 1. Pins 14 and 15 are provided for rotatably connecting the upper brackets 10 and 12, and the lower brackets 11 and 13, respectively. Accordingly, when respective brackets are linked by pins, the frame body 4 can be rotated about rotary axis 3*c* of the coupling unit 3. The frame body 4 is rotatable 180 degrees between the extending position (the position shown in FIG. 3) and the retracted (waiting) position (the positions shown in FIGS. 1 and 4). When the pins 14 and 15 are removed from the brackets under the jib supporting condition by coupling members 35 and 36 as described hereinafter, the coupling unit 3 is released so that the frame body 4 is disengaged from the end portion of the telescopic boom 1**.

In the embodiment, a shaft 16 for a horizontal sheave, which will be described hereinafter, is projected from a top of the bracket 10 of the frame body 4 coaxially with the axis of the pin 14 and hence the axis **3*c* of coupling unit 3. Thus, in order to couple respective brackets, the pin 14 is inserted into brackets 12 and 10 from a lower position of the bracket 12 and the pin 15 is inserted into brackets 13 and 11 from an upper position of the brackets 13**.

Further, a lock unit 5 is provided for securing the frame body 4 to the telescopic boom 1 at a front portion of the boom 1, cooperating with the coupling unit 3. The lock unit 5 comprises an upper bracket 17 and a lower bracket 18 formed on the other side of the frame body 4, and an upper bracket 19 and a lower bracket 20 formed on the other side of the innermost boom **1*b* of the telescopic boom 1. Connecting pins are provided for connecting upper brackets 17 and 19, and lower brackets 18 and 20**, respectively.

Figure 1:
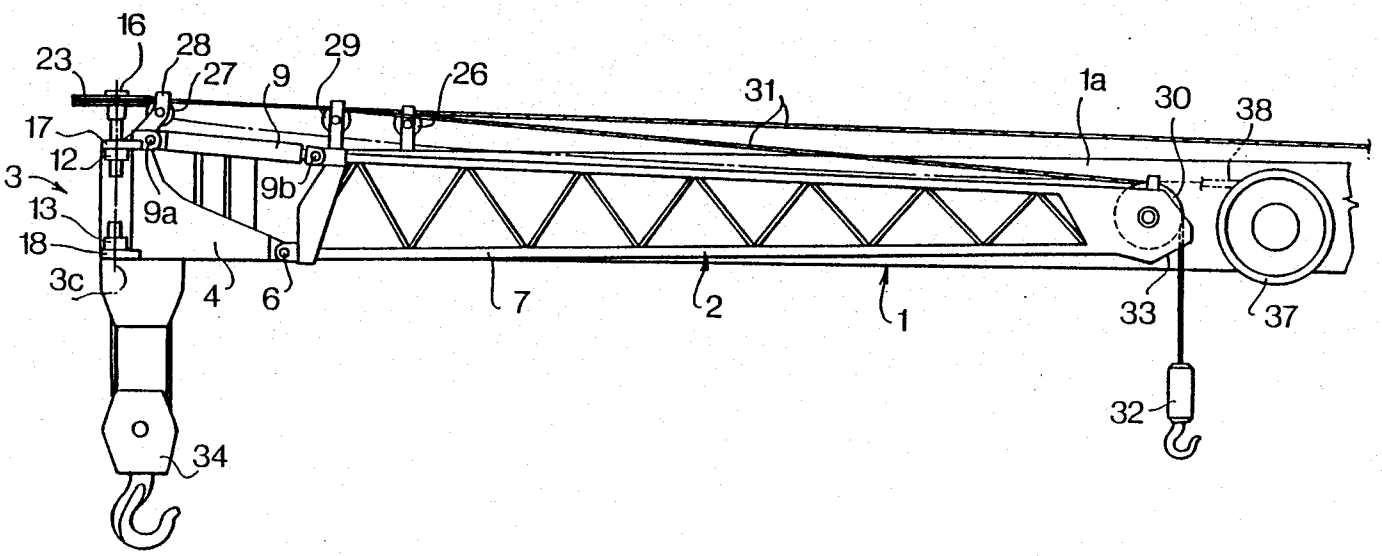
FIG. 1 is a side view showing an extension jib for a telescopic boom according to the present invention wherein the extension jib is in a retracted position.

A horizontal sheave 23 is rotatably mounted on the shaft 16 at an upper end thereof. A guide member 24 is secured to an arm **25*a* secured to a boss 25 which is rotatably supported on the shaft 16 at a lower position of the horizontal sheave 23. The guide member 24 is positioned adjacent the sheave 23, for preventing a wire rope 31 wound on the sheave from removing. A guide sheave 26 is provided on an upper portion of an outermost boom la of the telescopic boom 1 in position as shown in FIG. 1. A guide sheave 27 is rotatably supported in a bracket 28 which is provided on an upper portion of the frame body 4. A guide sheave 29 is disposed on an upper end portion of the jib body 7 near the pivot 9***b*. Numeral 30 designates a pulley provided on a tip end of the jib body 7. The wire rope 31 is pulled out from a winch (not shown) on the swivel stand, and is wound in order of the guide sheave 26, horizontal sheave 23, guide sheave 27, guide sheave 29, and pulley 30. A hook block 32 is attached to the end of the wire rope 31. The jib body 7 is formed with a bevelled end portion 33 on a lower portion of the tip end. When the wire rope 31 is wound up, the hook block 32 is adapted to abut the bevelled portion 33.

Referring to FIG. 4, in order to support the extension jib 2 in the retracted waiting position provided on the telescopic boom 1, a pair of coupling members 35 and 36 are provided on the outermost boom 1*a*. Each of coupling members 35 and 36 consists of an engaging member 35*a* provided on the boom 1*a* and a hook member 36*a* provided on the extension jib 2. Each of hook member is formed on one side of the jib body 7 in position and each of engaging member is formed on a side of the boom la corresponding to the hook member.

The hydraulic oil for operating the hydraulic cylinders 9 is supplied to the hydraulic cylinders 9 from a control valve on the swivel stand through hoses 38 wound on a hose reel 37 provided on the outermost boom la of the boom 1. The hydraulic cylinders 9 are operated by controlling the control valve.

The operations of the extension jib will be described hereinafter.

When the extension jib 2 is set in the retracted position, the coupling members 35 and 36 are coupled with each other, while the coupling unit 3 is disengaged. The extension jib 2 is supported along the outermost boom la of the boom 1. The crane is operated with a main block hook 34 of the telescopic boom 1.

When the extension jib 2 is used in the extended position, extending operations of the jib 2 is performed as follows.

(1) The telescopic boom 1 is contracted to an original position and brackets 10, 12 and 11, 13 of the coupling unit 3 are connected by pins 14 and 15, respectively.

(2) The coupling units 35 and 36 are disengaged When the coupling units 35 and 36 are released, the extension jib 2 is coupled to the telescopic boom 1 only by the coupling unit 3. The position of the jib body 7 about the horizontal shaft 6 is maintained by the hydraulic cylinders 9.

(3) The tip end of innermost boom 1*b* of telescopic boom 1 is raised to a proper height. This lifting angle of the boom 1 is such a degree that the tip end of jib body 7 may not touch the ground when the jib body 7 is downwardly rotated about the shaft 6, as shown in FIG. 2.

(4) The hydraulic cylinders 9 are extended, so that jib body 7 is downwardly rotated. The jib body is positioned at such an angle that the longitudinal axis of the jib body 7 is approximately in parallel with the axis 3*c* of the coupling unit 3 as shown in FIG. 2.

(5) The wire rope 31 is wound up by the winch and the hook block 32 is abutted onto the bevelled portion 33. The wire rope 31 around the horizontal sheave 23 is exerted on the frame body 4. Thus, the frame body 4 is horizontally rotated together with the jib body 7 about the axis 3*c* of coupling unit 3 in the clockwise direction in FIG. 4.

Since the longitudinal axis of the jib body 7 is maintained approximately in parallel with the axis 3*c* of the coupling unit 3, the jib 2 is rotated at a comparatively small force. Moreover, the tip end of the jib 2 (jib body 7) is rotated on a small rotating locus with a small radius.

(6) When the frame body 4 is rotated upto the front end of the innermost boom 1, the hydraulic cylinders 9 are controlled to be retracted. Thus, the jib body 7 is upwardly rotated about the shaft 6 and lifted up to the extended position in alignment with the boom 1 as shown in FIG. 3.

(7) The telescopic boom is downwardly turned and the lock unit 5 is engaged to secure the frame body 4 to the telescopic boom 1.

Accordingly, the extension jib 2 is longitudinally joined to the tip of the boom 1. Thus, the crane is operated with the hook block 32 suspended from the tip of the extension jib 2.

A connecting device for locking jib body 7 at a desired tilt angle may be provided between pivots 9*a* and 9*b*, so that the force to be exerted on cylinders 9 may be transmitted to the connecting device, thereby reducing the power of the.. cylinders. The connecting device, for example, comprises a telescopic device having a locking device for locking the telescopic device at a desired length.

In order to return the extension jib 2 to the retracted position from the extended position, the telescopic operations described in items (1) through (7) can be done in the reverse order. However, the frame body 4 can not be rotated back to the side of the boom la even if the operation described in the item (5) is done in reverse order. Therefore, a proper operation is performed as described below.

(5)′ The wire rope 31 is slightly loosed and the boom 1 is slight swiveled by rotating the swivel stand and stopped, so that the frame body 4 and jib 2 may be rotated to the waiting position by the inertia, or the tip of the jib 2 is attached to the ground and the boom 1 is swiveled to turn the jib 2 to the retracted position, or the jib 2 is manually turned by operators. When the jib 2 is caused to begin to rotate, the jib 2 is automatically turned to the retracted position by own weight.

Figure 6:
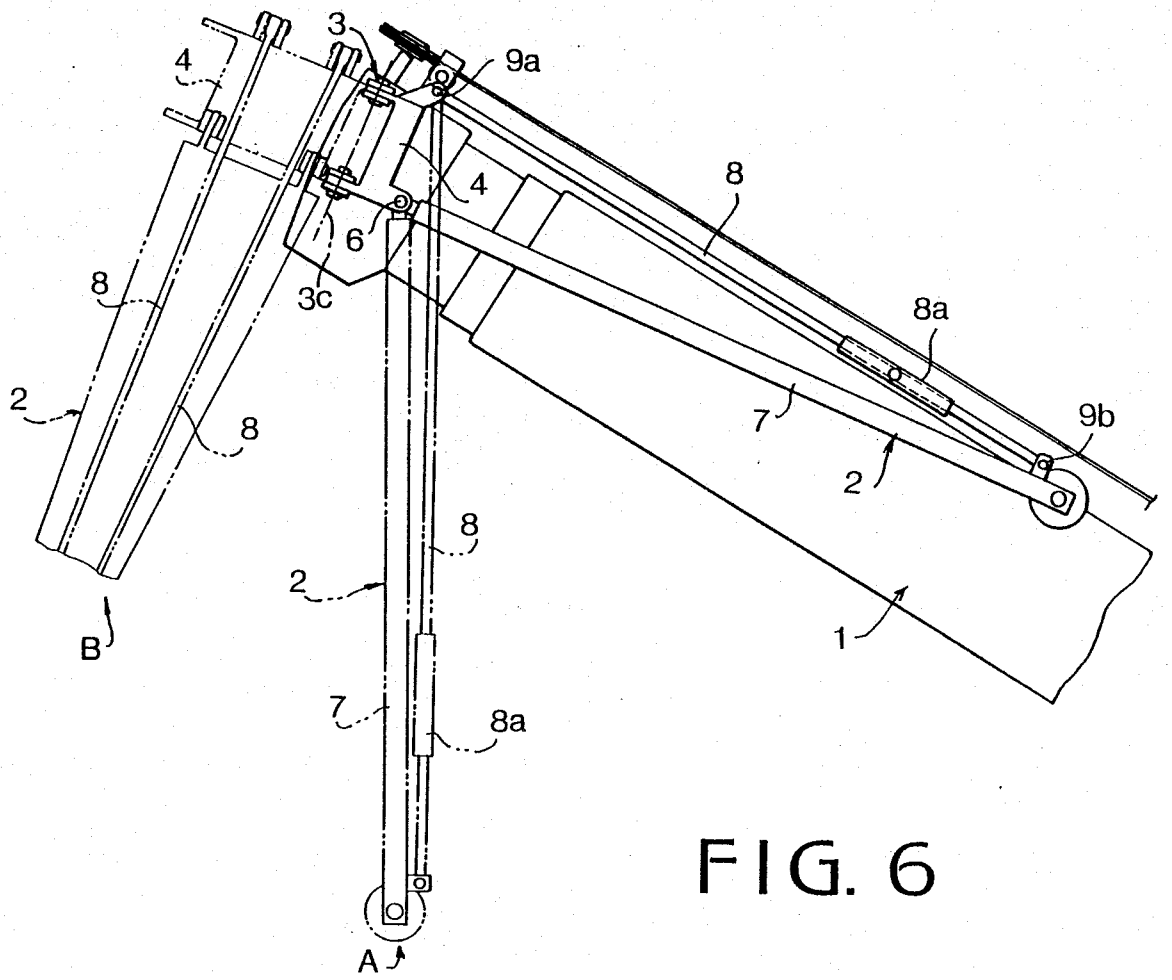
FIG. 6 is a side view of a conventional extension jib for a telescopic boom in the retracted state and the extending operation state.
Figure 7:
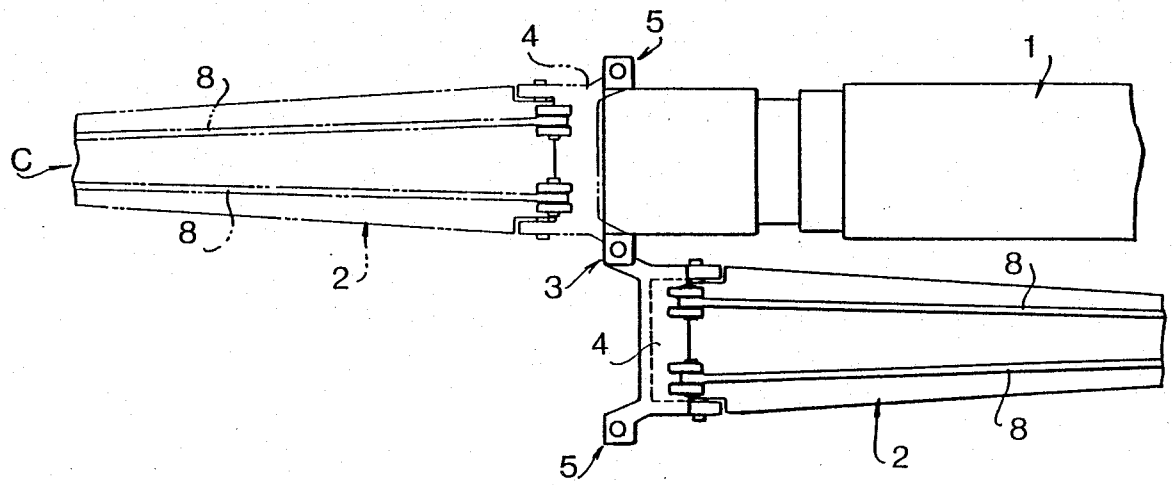
FIG. 7 is a plan view of the conventional structure.

FIGS. 6 and 7 show a conventional telescopic boom and an extension jib, in which the same parts as FIGS. 1 to 5 are identified by the same reference numerals. Frame body 4 is detachably connected to telescopic boom 1 through coupling unit 3. Jib body 7 of extension jib 2 is pivotally connected to the frame body 4 by horizontal shaft 6. A pair of rods 8 are pivotally connected to the frame body 4 through pivots 9*a* and connected to ends of the jib body 7 through pivots 9*b*, respectively.

The coupling unit 3 is similar to the coupling unit 3 of the present invention shown in FIGS. 1 to 5.

In order to position the extension jib 2 at an extended position, first the telescopic boom 1 is raised and each rods 8 is extended by releasing a locking connector 8*a*. Accordingly, extension jib 2 rotates to a vertical position A in FIG. 6. Then the jib 2 is rotated about axis 3*c* to the tip end position of the boom 1 passing the position B in FIG. 6 which is at an angular position of 90 degrees from position A. The jib 2 is connected to the boom at brackets in the same manner as the present invention. Thereafter, the jib 2 is rotated to the extended position C in FIG. 7.

The rotation of the extension jib is done about the axis 3*c* which is inclined with respect to the vertical line as shown in FIG. 6. Accordingly, the extension jib is rotated with a large radius passing the maximum extending position B. Therefore, a large space is required for extending the jib and the operation may incur a danger.

In accordance with the present invention, the extension jib is lowered to a position where the longitudinal axis thereof is substantially parallel with the axis of the pivot of the rotation between the extended position and the retracted position. Accordingly, the extension jib is rotated within a small space without dangerous operations.

While the presently preferred embodiment of the present invention has been shown and described, it is to be understood that this disclosure is for the purpose of illustration and that various changes and modifications may be made without departing from the spirit and scope of the invention as set forth in the appended claim.

What is claimed is:

1. A extension jib for a telescopic boom having an innermost boom with a front end, the extension jib comprising a frame body having a base portion and being rotatably and detachably connected on one side of front end of innermost boom of the telescopic boom at one side of the base portion by connecting means so as to be rotated about a rotary axis which is laterally offset to the side of the innermost boom, a jib body rotatably connected to the frame body at an end opposite the base portion by a horizontal shaft, locking means for locking the other side of the base portion of the frame body to the front end of the innermost boom so that the frame body is positioned in alignment with the innermost boom at the front end thereof, and hydraulic cylinder means provided between the jib body and the frame body in such a manner that the jib body is rotated about the horizontal shaft by the operation of the hydraulic cylinder means, the hydraulic cylinder means having a stroke sufficient to rotate the jib body from a retracted position where the jib body is located along a side of the telescopic boom and a longitudinal axis of the jib body is substantially parallel with a longitudinal axis of the boom to a lower position where the longitudinal axis of the jib body is substantially parallel with the rotary axis whereby the extension jib may be rotated from the lower position to the front end position of the innermost boom about the rotary axis keeping the relative position of the jib body at the lower position with respect to the frame body.

2. The extension jib according to claim 1 wherein the connecting means comprises corresponding brackets formed on the end of the boom at one of sides of the end and on the frame body at one of sides thereof, and pins engaged with holes of corresponding brackets.

3. The extension jib according to claim 1 wherein the locking means comprises corresponding brackets formed on the frame body at the other side and on the other side of the boom, and pins engage with holes of corresponding brackets.

4. The extension jib according to claim 1 wherein the hydraulic cylinder means are a pair of oil hydraulic cylinders provided between the base portion of the extension jib and an upper portion of the frame body.

* * * * *